US005191918A

United States Patent [19]

Cahlander et al.

[11] Patent Number: 5,191,918

[45] Date of Patent: Mar. 9, 1993

[54] FOOD DISPENSER AND METHOD

[75] Inventors: Robert L. Cahlander, Red Wing; David W. Carroll, Cannon Falls, both of Minn.; Alfred C. Hollingsworth, Naperville, Ill.; Gregory A. Lawrence, Red Wing; Brian R. Rudesill, Woodbury, both of Minn.

[73] Assignee: Restaurant Technology, Inc., Oak Brook, Ill.

[21] Appl. No.: 519,068

[22] Filed: May 4, 1990

[51] Int. Cl.[5] ..... B65B 1/04; B65B 1/30

[52] U.S. Cl. ..... 141/1; 141/172; 141/129; 99/407; 177/114; 222/56

[58] Field of Search ..... 141/1, 83, 172, 129, 141/153, 156, 157, 159, 161, 165, 168, 171, 176, 148, 253, 275; 99/407, 404; 426/108; 177/114; 222/56, 58, 77, 414; 221/158, 224, 225, 236

[56] References Cited

U.S. PATENT DOCUMENTS

| | | | |
|---|---|---|---|
| 1,630,676 | 5/1927 | Smith | 99/404 |
| 1,927,318 | 9/1933 | McEntee et al. | 141/65 |
| 1,961,990 | 6/1934 | Sleeman | 34/172 |
| 2,466,386 | 4/1949 | Curioni | 222/56 |
| 2,475,523 | 7/1949 | Schroeder | 99/404 |
| 2,534,997 | 12/1950 | Smith | 141/148 |
| 2,575,643 | 11/1951 | Tamsen | 34/225 |
| 2,679,859 | 6/1954 | Kummer | 141/148 |
| 2,777,212 | 1/1957 | McOmber | 34/86 |
| 2,807,203 | 9/1951 | Buechele et al. | 99/404 |
| 3,404,742 | 10/1968 | Bonneric | 141/83 |
| 3,408,920 | 11/1968 | Smith, Jr. | 99/407 |
| 3,412,478 | 11/1968 | Satake | 34/172 |
| 3,442,423 | 5/1969 | Cozad | 222/436 |
| 3,448,677 | 6/1969 | Dexters | 99/336 |
| 3,474,891 | 10/1969 | Kamila | 198/397 |
| 3,505,072 | 4/1970 | Rullman | 99/407 |
| 3,645,196 | 2/1972 | Johnston et al. | 99/407 |
| 3,685,432 | 8/1972 | Hoeberigs | 99/357 |
| 3,690,247 | 9/1972 | Van Cleven et al. | 99/355 |
| 3,716,383 | 2/1973 | Yamamura | 99/353 |
| 3,805,689 | 4/1974 | Berger et al. | 141/83 |
| 3,866,795 | 2/1975 | Urano | 221/150 HC |
| 3,942,426 | 3/1976 | Binks et al. | 99/473 |
| 4,163,489 | 8/1979 | Wahl | 222/56 |
| 4,228,730 | 10/1980 | Schindler et al. | 99/407 |
| 4,233,495 | 11/1980 | Scoville et al. | 219/386 |
| 4,266,691 | 5/1981 | Wolwowicz | 141/83 |
| 4,437,396 | 3/1984 | Plattner et al. | 99/475 |
| 4,489,647 | 12/1984 | Stamps | 99/407 |
| 4,687,119 | 8/1987 | Juillet | 221/225 |
| 4,719,849 | 11/1988 | Cope et al. | 99/407 |
| 4,809,881 | 3/1989 | Becker | 221/224 |

FOREIGN PATENT DOCUMENTS

| | | | |
|---|---|---|---|
| 2491031 | 4/1982 | France | 99/407 |
| 5078345 | 1/1977 | Japan | 141/129 |

*Primary Examiner*—Henry J. Recla
*Assistant Examiner*—David J. Walczak
*Attorney, Agent, or Firm*—Jenner & Block

[57] ABSTRACT

A portioning dispenser for bulk food items is disclosed which receives bulk food items in a storage bin, portions food items from the storage bin, and dispenses measured portions of food items for further processing. The dispenser can include a rotary drum for conveying food items from the storage bin and a load cell for weighing the quantity of items conveyed from the storage bin into a secondary bin. The dispenser can also include a conveyor system for sequentially accepting, filling and returning a plurality of portion containers. In another embodiment of the invention, a method is disclosed for dispensing measured portions of bulk food items which includes several of the above-discussed operations.

40 Claims, 6 Drawing Sheets

10
30
32
68
E
F
82
G
H
64
70
72
66
74
54
M
D
C
B
12

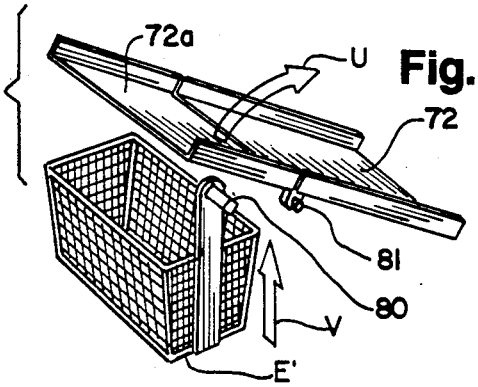
Fig. 7
Fig. 6
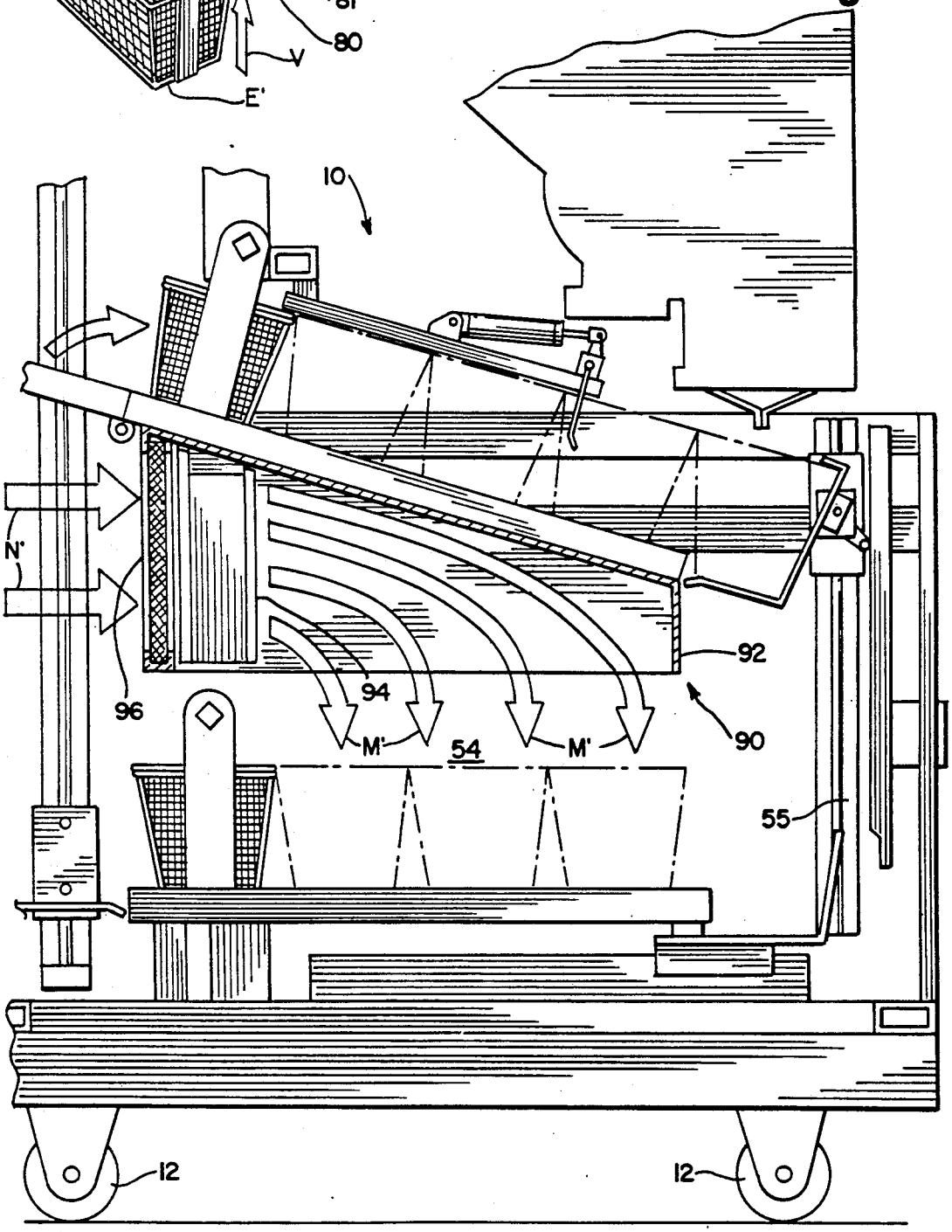

FOOD DISPENSER AND METHOD

FIELD OF THE INVENTION

The invention relates to an apparatus and method for the automatic portioning and dispensing of bulk food items, especially for quick service restaurants. More particularly, the invention relates to an apparatus and method for automatically dispensing portions of food items from a reservoir designed to receive items from a bulk food item container.

BACKGROUND OF THE INVENTION

In restaurants, especially quick service (fast food) restaurants, fast, consistent, efficient and safe food preparation is essential for a successful operation. One important task frequently required in the preparation of fast food is the portioning of bulk food items supplied in bulk food containers.

Bulk food items are typically supplied in containers weighing several pounds to several tens of pounds. Each container holds a large number of individual food items such as french fries or chicken nuggets. The use of bulk containers is efficient because it minimizes the number of individual containers which must be transported to, handled, and stored at a restaurant. Because it is typically unnecessary, undesirable or impossible to prepare the entire contents of a given container at one time, the bulk food items must be portioned before cooking, heating or other processing can be performed.

Portioning of bulk food items involves many of the efficiency, speed, safety and consistency considerations involved in quick service food preparation generally. For example, consistent food preparation requires that portions be of a uniform size because over- or under-sized portions may yield an under- or over-prepared food product when the portion is cooked, heated or otherwise processed. Additionally, portioning should be performed quickly to minimize food preparation delays to help insure prompt service. Furthermore, portioning operations should be non-labor intensive so as to efficiently utilize restaurant labor, particularly when such workers are in high demand and difficult to procure. Finally, portioning operations should minimize the manual manipulation of food products by restaurant workers, thereby minimizing safety concerns related to food handling generally.

Although quick service restaurants have existed for many years and now number in the tens of thousands, these establishments typically utilize labor intensive, manual processes to portion the contents of containerized bulk food products.

Accordingly, a need exists for a commercially suitable portioning apparatus for containerized bulk food items that minimizes manual food handling, requires little operator attention, and quickly, automatically and accurately portions bulk food items for serving, cooking or further preparation.

SUMMARY OF THE INVENTION

In accordance with the present invention, a portioning dispenser for bulk food items is disclosed that is especially adapted for a fast food restaurant. The dispenser is capable of receiving and storing bulk food items from a bulk food item container. The bulk food items can be any food product which requires proper portioning for preparation or serving. For example, the food product could be a meat, fish or poultry "nugget" product, or a vegetable product such as french fries. The food product could be cooked or uncooked, and could be in either a frozen or non-frozen condition.

More specifically, in one embodiment of the invention, structure is included for receiving and holding a quantity of bulk items, transferring at least some of the held items to a portion receiving device located at a container filling station, conveying a container to and from the filling station, and discharging items from the portion receiving device to the conveyed container. Additional features can include structure for measuring the quantity of items present in the portion receiving device, and for sequentially accepting empty containers and returning filled containers.

In another embodiment, a bulk food storage bin contains food items from one or more bulk containers. A portion of the bin contents are then transferred directly to a container such as a fry basket or to a secondary bin for improved uniformity in dispensing which then discharges the bin contents into an empty container located at a container filling station. Additional features can be included such as a load cell for measuring the contents of the secondary bin and initiating emptying of the secondary bin when a predetermined amount of food items are present, as well as a conveyance system for transferring empty containers to and from the container filling station.

In yet another embodiment of the dispenser, a storage bin is provided for holding a quantity of food items in bulk such as, for example, french fries or chicken nuggets. A rotary drum is provided to dispense a portion of the storage bin contents into an optional secondary bin. The secondary bin includes a bin door for releasing the secondary bin contents when a measuring device indicates that a desired quantity of items has accumulated in the bin. A conveyance system is included to supply empty baskets to and return empty baskets from a container filling station. Additional features can include a pair of container elevators for moving filled bins to and from a container staging area as well as a filled container push arm for moving filled baskets across the staging area.

In still another embodiment of the dispenser invention, a reservoir is provided for holding a quantity of food items in bulk. A rotary drum conveys food items from the storage bin into a secondary bin. A measuring device measures the weight of the secondary bin contents and opens a bin door when a desired quantity of items is present in the bin, thereby discharging the items by gravity into a basket at a basket filling station. Baskets are moved to and from the basket filling station by a conveyor system having an inclined ramp and a pair of elevators. The ramp allows empty baskets to slide towards the filling station, and the basket elevators lower and raise filled baskets to and from a filled basket staging area.

In yet another embodiment of the invention, a method is provided for dispensing bulk food items into containers for further processing. Bulk items are first emptied into a container reservoir and subsequently discharged into a bin. The bin is emptied when a desired portion of food items has been measured in the bin. Additional features can include conveying an empty basket down an inclined ramp towards a container filling station, lowering a filled basket to a filled basket staging area, pushing the basket into the staging area, and removing another filled basket from the staging area.

In accordance with one aspect of the invention, a food dispenser is provided which can portion bulk food products for further processing.

In accordance with another aspect of the invention, a food dispenser is provided for portioning bulk food products which minimizes manual handling of food products which in turn minimizes safety and sanitation concerns related to the manual handling of food products.

In accordance with still another aspect of the invention, an automated portioning dispenser for bulk food products is provided which eliminates the need for manual portioning operations, thereby reducing labor costs and labor requirements.

BRIEF DESCRIPTION OF THE DRAWINGS

FIG. 6 is a side elevation view of one embodiment of the dispenser invention which incorporates an optional air thaw system; and FIG. 7 is a perspective view of another embodiment of the pivotable door ramp shown in FIG. 5.

DETAILED DESCRIPTION OF THE INVENTION

One embodiment of a portioning dispenser for portioning bulk food items is shown in FIGS. 1–5. Throughout these FIGURES, like numbers refer to like parts. Although the illustrated embodiment is adapted to the portioning of french fries, the dispenser can portion other items such as meat, fish or poultry nuggets, and can dispense either fresh or frozen items in either a cooked or uncooked condition.

Figure 1:
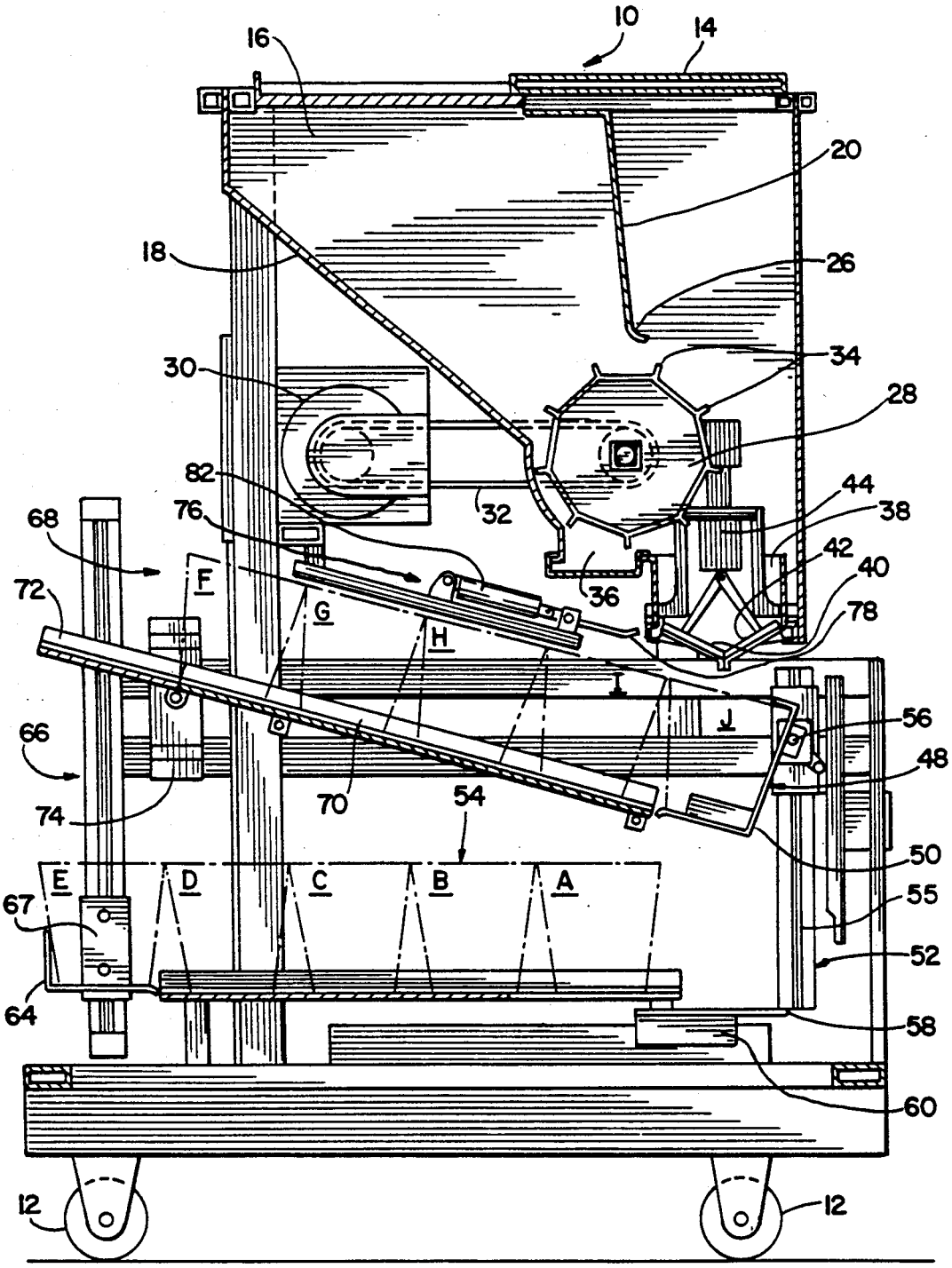
FIG. 1 is a front elevation view of one embodiment of the dispenser invention showing the internal structures of the invention.

FIG. 1 illustrates the general internal arrangement of components in a portioning dispenser 10 for bulk food items. The components of dispenser 10 are generally located within a cabinet 11 mounted on four wheels 12. Cabinet 11 includes a sliding door 14 which allows french fries to be dumped into a primary storage bin 16 from a bulk french fry container when door 14 is open.

Storage bin 16 includes an inclined reservoir wall 18 and a vertical reservoir wall 20 which, in conjunction with a pair of reservoir side walls 22 and 24 (see FIG. 2), channel bulk food items toward the bottom of storage bin 16.

Figure 2:
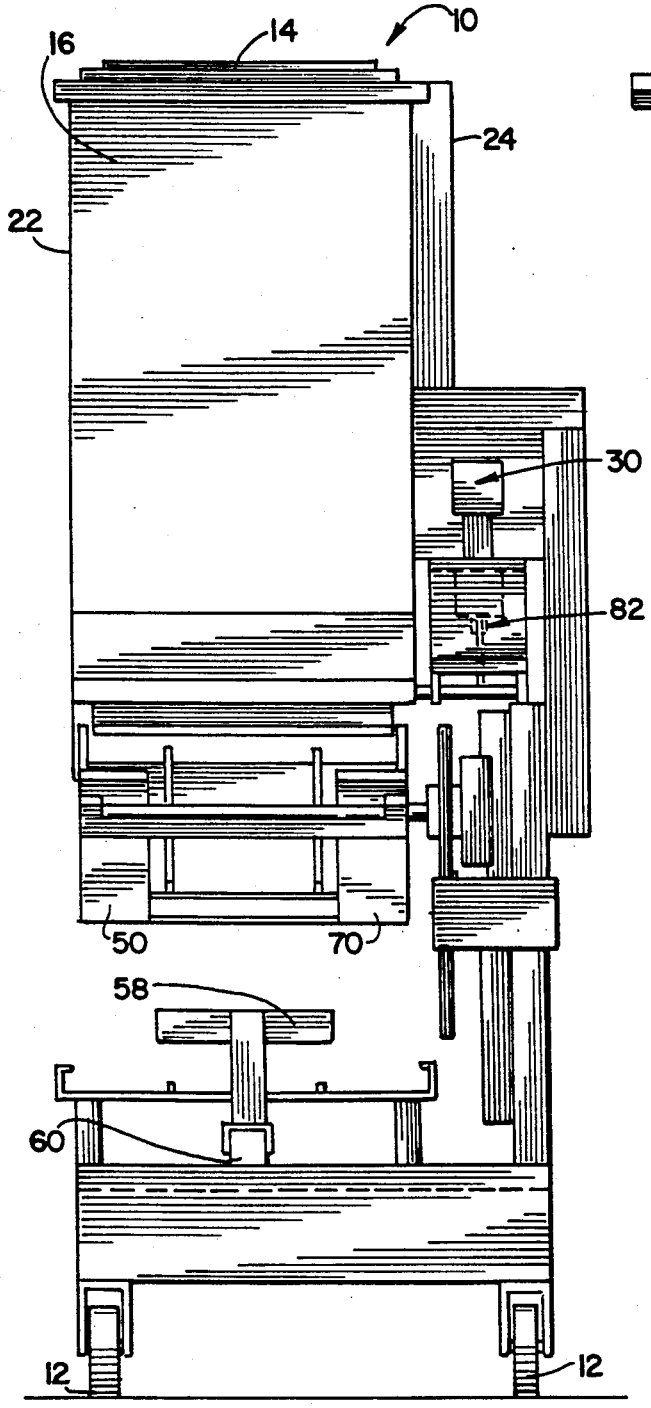
FIG. 2 is a simplified side elevation view of the embodiment illustrated in FIG. 1.
Figure 2A:
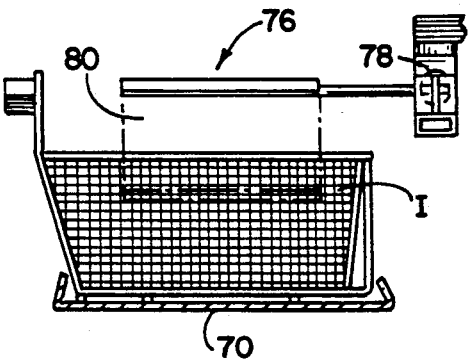
FIG. 2*a* is a side elevation view along lines 2*a*–2*a* of FIG. 4.
Figure 2B:
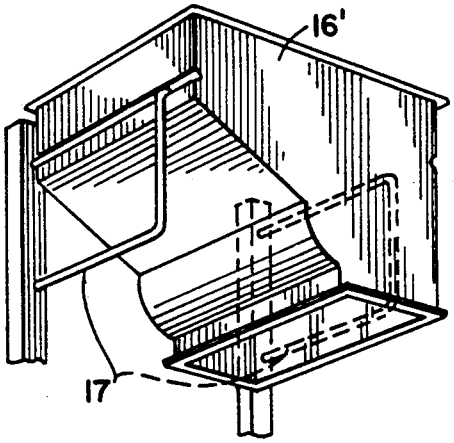
FIG. 2*b* is a perspective view of an alternate hopper embodiment useful in the dispenser of FIG. 1.

An alternate storage bin 16′ is illustrated in perspective view in FIG. 2*b*. Bin 16′ can be molded plastic and can be supported by support rods 17 located on each side of bin 16′. Support rods 17 allow bin 16′ to be removed by sliding bin 16′ horizontally out from rods 17.

French fries contained in storage bin 16 are conveyed by clockwise rotation of a rotary drum 28 located near the bottom of storage bin 16. Drum 28 is driven by an electric motor 30 and a drive belt 32 and includes a plurality of paddles 34. Paddles 34 convey fries from storage bin 16 past a fry deflector 26 when drum 28 rotates. As one alternative, grooves (not shown) could be provided on the surface of drum 28 in place of paddles 34. Deflector 26 operates in conjunction with paddles 34 and drum 28 to regulate and smooth the flow of fries from storage bin 16. Food items too small to be conveyed out of storage bin 16 by paddles 34 fall into a crumb tray 36 located at the bottom of storage bin 16. Tray 36 catches items such as crumbs and small pieces of broken french fries, thereby preventing these undesirable items from passing over drum 28 and into the dispensed french fry portions.

Fries pushed from storage bin 16 fall into a secondary bin 38 for weighing and dispensing. Secondary bin 38 includes a pair of downwardly opening doors 40 and 42 which open when a load cell 44 indicates that a desired weight of french fries has accumulated in secondary bin 38. Fries discharged from bin 38 fall into a fry basket J (shown in phantom) at a basket filling station 48. Secondary bin 38 and associated equipment for weighing is optional. Fries may be discharged directly into a basket at filling station 48 without secondary bin 38. At filling station 48, basket J sits on a basket frame 50. Frame 50 is part of a first elevator 52 used to lower filled baskets to a basket staging area 54. In the illustrated embodiment, elevator 52 employs a first elevator rodless cylinder 55 to provide vertical movement. Elevator 52 also includes a pivot mechanism 56 for pivoting frame 50 from an inclined orientation at filling station 48 to a horizontal orientation required to push basket J into staging area 54. Alternatively, pivot mechanism 56 could be omitted. In this case, basket J is simply pushed from an inclined frame into staging area 54, where the basket bottom comes to rest in a horizontal orientation.

Baskets lowered to staging area 54 are sequentially moved through area 54 by the action of a basket transfer arm 58. After elevator 52 has lowered basket frame 50 to staging area 54, horizontal basket transfer arm 58 pushes a filled basket from basket frame 50 into staging area 54. Transfer arm 58 is moved by actuating a horizontally moveable rodless staging cylinder 60 located below staging area 54. Any suitable motive means can be used to move transfer arm 58.

When staging area 54 is filled with full baskets, transfer arm 58 causes all baskets in staging area 54 to be pushed forward one basket position. This causes a basket E (shown in phantom in FIG. 1) to be pushed onto a basket frame lift 64 of a second elevator 66. A second elevator rodless cylinder 67 is then actuated to raise elevator 66 to a basket input-output station 68.

In addition to serving as a return point for filled baskets, basket input-output station 68 serves as a drop off point for empty fry baskets. An empty basket (not shown) placed on an inclined ramp 70 can slide towards basket filling station 48. Inclined ramp 70 includes a pivotable door 72 which can be moved by actuating a door cylinder 74 to allow filled baskets to pass by ramp 70 when raised on second elevator 66. Ramp 70 is inclined sufficiently so that baskets placed thereon will slide by gravity to basket filling station 48, unless restrained by basket stop arm 78, hereinafter described.

A basket stop mechanism 76 is mounted above ramp 70 for preventing empty baskets from sliding down ramp 70 at certain times in the filling cycle. Mechanism 76 includes a basket stop arm 78 which can be lowered into a basket (basket J in FIG. 3) to prevent movement of basket J and all baskets on ramp 70 above basket J. Stop arm 78 is lowered by actuating a basket stop air cylinder 82.

Various aspects of the location and shape of several of the above-discussed components are illustrated more clearly in FIG. 2. First, it should be noted that rotary drum motor 30 and basket stop cylinder 82 are mounted off to one side of cabinet 11. These mounting positions prevent contaminants or foreign objects, which might possibly otherwise fall from either device, from falling into baskets during the dispensing process. FIG. 2 also illustrates that basket transfer arm 58 engages a substantial portion of the top side of a fry basket, while FIG. 2*a* shows that transfer arm 58 engages a substantial length of a lower side of a fry basket F.

The operation of dispenser 10 now will be discussed in conjunction with FIGS. 3, 4 and 5. The following sequence of operations is intended only to be representative of the illustrated embodiment, and may be controlled by any type of controller known in the art. Unless otherwise specified, cylinders are two position pneumatic cylinders and cylinder actuation refers to moving a cylinder from one cylinder position to the other position.

Figure 3:
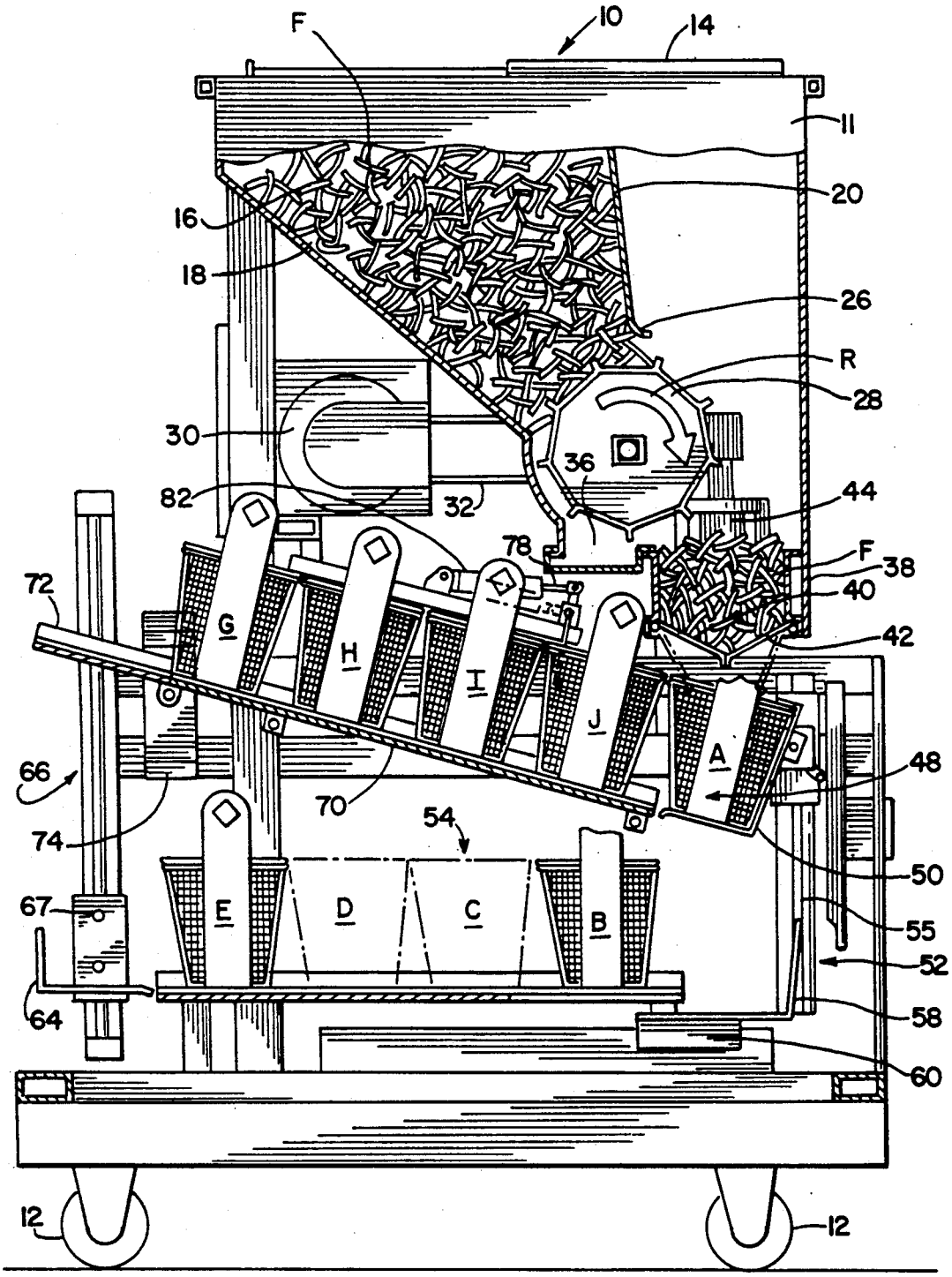
FIG. 3 is a side elevation view of the embodiment of FIG. 1 illustrating the basket filling operation.

Referring now to FIG. 3, dispenser 10 is made ready for operation by filling storage bin 16 with french fries F such as from a bulk french fry container or other source. The basket filling cycle begins when basket stop cylinder 82 is actuated, causing stop arm 78 to be raised from the lowered position shown in FIG. 3 to the position shown in FIG. 4. A reed switch (not shown) verifies that stop arm 78 is in the raised position, and an empty fry basket A slides down inclined ramp 70 onto basket frame 50. After basket A slides onto frame 50, stop cylinder 82 is actuated, and stop arm 78 returns to its original lowered position for retaining the empty baskets G, H, I and J on ramp 70 as shown in FIG. 3.

When basket A slides into frame 50, an elevator sensor (not shown) verifies that basket A is present, and rotary drum motor 30 is energized. Motor 30 causes rotary drum 28 to rotate in the direction of arrow R and convey french fries from storage bin 16 into secondary bin 38. After approximately 1.5 pounds of french fries have fallen into secondary bin 38, load cell 44 provides a signal which causes drum 28 to stop rotating and then activates a pair of secondary bin door air cylinders (not shown) to cause bin doors 40 and 42 to open downwardly, which allows the measured portion of fries F to fall into basket A. The bin door cylinders are then actuated again to close doors 40 and 42.

After basket A has been filled, first elevator 52 lowers basket A from filling station 48 to the level of staging area 54. Referring now to FIG. 4, pivot mechanism 56 turns lowered basket frame 50 from the inclined orientation required to accept empty basket A from ramp 70 to the horizontal orientation required to dispatch filled basket A into staging area 54. A reed switch (not shown) verifies the position and orientation of frame 50, and if frame 50 is in the proper location, staging cylinder 60 is actuated, causing basket transfer arm 58 to push basket A into staging area 54.

Figure 4:
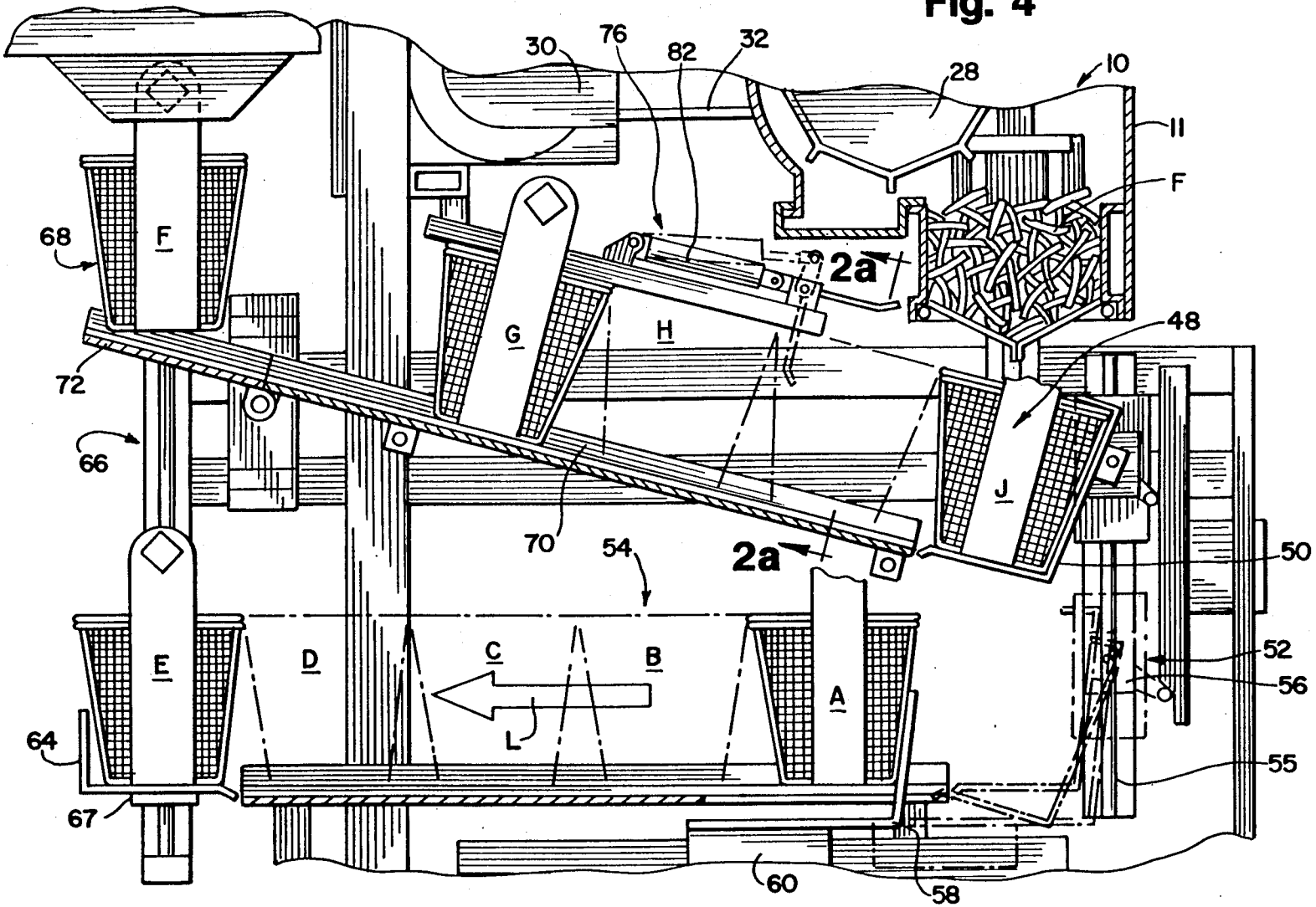
FIG. 4 is a fragmentary side elevation view of the conveyor system shown in FIG. 1 which illustrates basket filling and basket staging.
Figure 5:
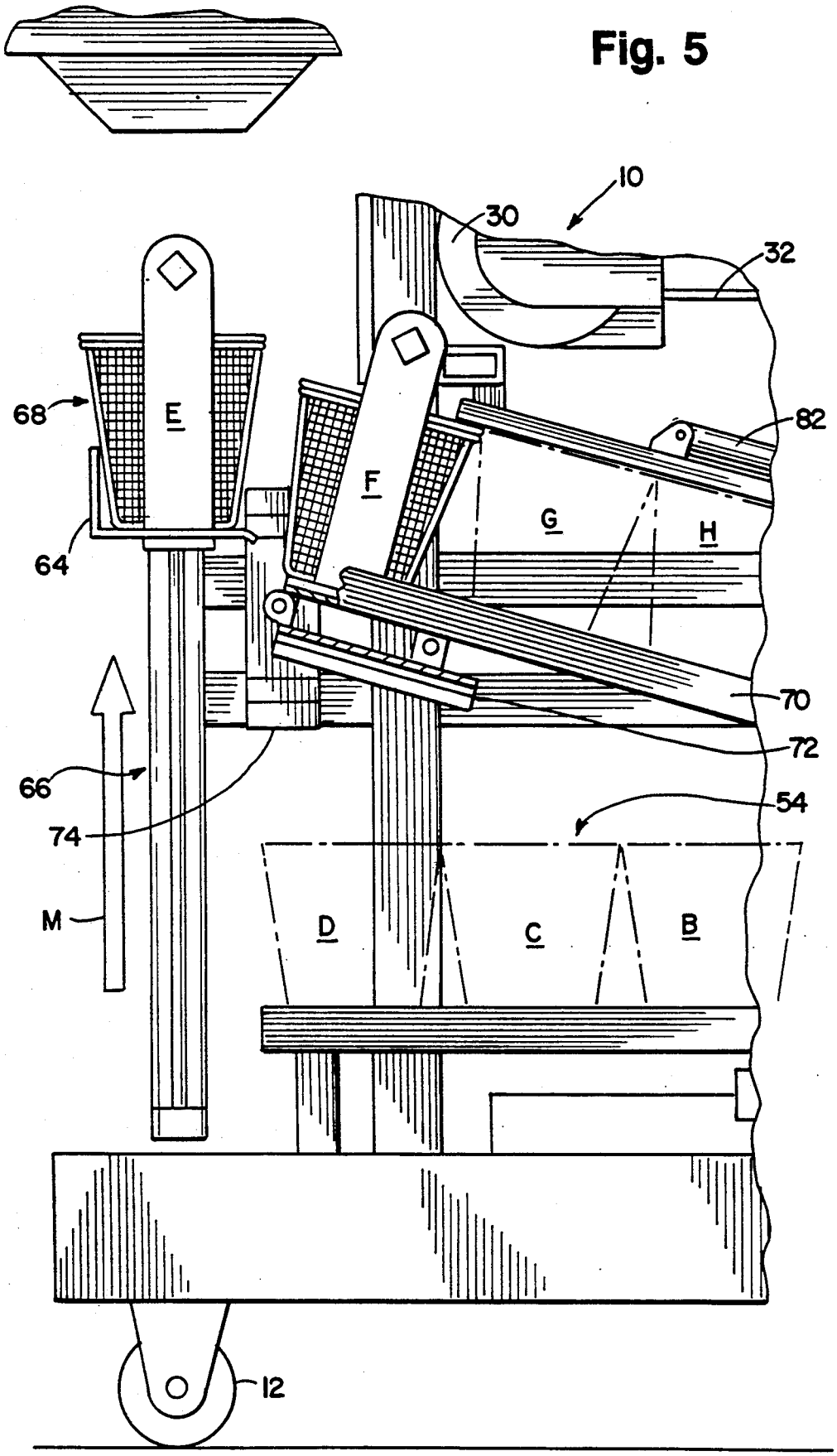
FIG. 5 is an enlarged fragmentary side elevation view of the part of the conveyor system of FIG. 4 which illustrates the raising of a filled basket from the basket staging area to the basket input-output station.

As can be seen by comparing FIG. 4 to FIG. 3, moving basket A causes baskets B, C, D and E to advance to the left in the direction of arrow L through staging area 54 one basket position. As a result, basket E now has been pushed onto basket frame lift 64. A first elevator sensor (not shown) verifies that basket frame 50 is empty, and frame 50 is lifted back up to filling station 48. Transfer arm 58 can be activated to advance the baskets in the staging area to the left two basket positions, if desired, such as when only four baskets (A, B, C and D, for example) are present in staging area 54.

Turning now to FIG. 4, it will be noted that an empty basket F has been placed on ramp door 72. When basket F is released, it will slide past door 72 and onto a fixed portion of ramp 70 as shown in FIG. 5.

Filled basket E is now ready to be lifted to basket input-output station 68 by second elevator 66. Referring again to FIG. 5, a second elevator sensor (not shown) verifies that basket E is correctly positioned on lift frame 64, pivotable door 72 is lowered to allow basket E to pass past ramp 70, and second elevator 66 lifts basket E in the direction of arrow M to input-output station 68. Basket E is then removed from elevator 66. A second elevator pick-up sensor indicates that elevator 66 is empty, and elevator 66 is returned to the staging area, and the filling and conveying cycles can be repeated.

FIG. 6 illustrates an optional air thaw system 90 for dispenser 10 consisting of an air plenum 92, a fan 94 and a filter 96. Fan 94 pulls air (arrows N') through filter 96 and into plenum 92 which directs the air downwardly (arrows M') into fry baskets for thawing french fries located in staging area 54.

Turning now to FIG. 7, an alternative embodiment of pivotable door 72 is shown in which an upwardly pivotable door 72*a* pivots above ramp 70 in the direction of arrow U when a basket E' is raised from below in the direction of arrow V. The pivotable door movement is initiated when basket handle 80 of basket E' pushes a door lever 81 upward as basket E' is raised. When basket E' is removed, door 72*a* falls down to its normal position.

While the invention has been described with respect to the illustrated embodiment, it is to be understood that the invention can accommodate numerous changes, modifications and rearrangements without departing from the invention as described by the appended claims.

What is claimed is:

1. A dispenser for dispensing bulk food items into a container comprising:

a storage bin for receiving and holding a quantity of bulk food items;

secondary bin receiving means for receiving at least a portion of bulk food items of desired size from said storage bin;

conveyor means for conveying food items from said storage bin to said secondary bin receiving means;

container conveyance means for conveying a container to and from a container filling station along a generally continuous path located within a single substantially vertical plane, said path having at least one horizontal and one vertical component, the container being slidably conveyed on said conveyance means along said horizontal component;

discharge means for dispensing items from said secondary bin means into an empty container at said filling station; and measuring means for measuring the quantity of food items present in said secondary bin receiving means and initiating the dispensing of food items from said secondary bin receiving means in response to a measured predetermined quantity of food items in said secondary bin receiving means;

wherein said container conveyance means includes means for sequentially accepting a plurality of empty containers, sequentially conveying said empty containers to a filling station, and sequentially discharging filled containers from said filling station; and wherein said container conveyance means further includes a downwardly inclined ramp for accepting and slidably conveying empty containers towards said filling station.

2. The dispenser of claim 1 wherein said container conveyance means further includes container stop means for preventing any empty containers on said inclined ramp from sliding downwardly when a filled container is moved from said container filling station.

3. The dispenser of claim 1 wherein said inclined ramp includes a pivotable door for allowing at least a portion of said ramp to be moved to allow filled containers to pass through said ramp from below.

4. A dispenser for dispensing bulk food items into a container comprising:

a storage bin for receiving and holding a quantity of bulk food items;

secondary bin receiving means for receiving at least a portion of bulk food items of desired size from said storage bin;

conveyor means for conveying food items from said storage bin to said secondary bin receiving means;

container conveyance means for conveying a container to and from a container filling station along a generally continuous path located within a single substantially vertical plane, said path having at least one horizontal and one vertical component, the container being slidably conveyed on said conveyance means along said horizontal component;

discharge means for dispensing items from said secondary bin means into an empty container at said filling station; and air thaw means for directing air into said dispenser and toward filled containers to thaw frozen food items contained in the filled containers.

5. A dispenser for dispensing bulk items into a container comprising:

a storage bin for accepting and holding a quantity of bulk food items and having a discharge opening along a bottom portion thereof;

a secondary bin located below said storage bin for receiving a portion of desired size from the items in said storage bin;

storage bin conveying means located at least partially within said discharge opening for conveying items from said storage bin to said secondary bin; and secondary bin emptying means for dispensing the contents of said secondary bin by gravity into an empty container at a bin emptying station, said secondary bin emptying means being located substantially within a vertical plane defined by a path of container travel to and from the bin emptying station;

measuring means for measuring the weight of items in said secondary bin prior to dispensing from said secondary bin; and conveyance means for transporting at least one container to and from said storage bin emptying station;

wherein said conveyance means includes an inclined ramp for allowing an empty container to slide by gravity to said emptying station.

6. The dispenser of claim 5 wherein said conveyance means includes a container stop mechanism for preventing an empty container from sliding down said ramp by gravity when a container is removed from said emptying station.

7. The dispenser of claim 5 wherein said ramp includes a pivotable door for allowing said conveyance means to raise a filled container past said door when said door is moved from an original inclined ramp position.

8. The dispenser of claim 5 wherein said storage bin conveying means comprises a rotary drum for conveying food items from said storage bin.

9. A food dispenser for dispensing a portion of bulk food items into a container comprising:

a storage bin for accepting and holding a quantity of food items and having a discharge opening along a bottom portion thereof;

a secondary bin for receiving a portion of desired size of food items from said storage bin;

a rotary drum connected between said storage bin and said secondary bin for transferring food items from said storage bin to said secondary bin;

at least one secondary bin door on said secondary bin for dispensing food items from said secondary bin;

measuring means for measuring the contents of said secondary bin and initiating the opening of said at least one secondary bin door when a predetermined amount of food items is measured in said secondary bin; and conveyor means for accepting empty removable containers, transporting empty containers to a filling station for filling from said secondary bin, and removing the filled containers from said filling station, said containers being slidably conveyed on the conveyor system during operation of said conveyor system and said conveyor system conveying said baskets along a generally continuous path within said dispenser, the path being located within a single substantially vertical plane.

10. The dispenser of claim 9 wherein said conveyor means includes an inclined ramp for allowing empty containers to slide by gravity towards said filling station.

11. The dispenser of claim 10 wherein said conveyor means includes a container stop mechanism for preventing an empty basket from sliding down said ramp by gravity when a container is removed from said filling station.

12. The dispenser of claim 9 wherein said conveyor means includes:

a first container elevator having a container frame for supporting a container at said filling station and for lowering the filled container to a filled container staging area after the container has been filled;

a second container elevator for lifting a filled container from said staging area; and a container transfer arm for pushing the filled container horizontally from said first elevator and for advancing any filled containers already present in said staging area toward said second elevator, thereby pushing a filled container nearest said second elevator onto said second elevator.

13. The dispenser of claim 12 further comprising an air thaw system for directing air toward said filled container staging area for thawing frozen food items held in said container.

14. The dispenser of claim 12 wherein said first container elevator includes a pivot mechanism for pivoting said basket frame between an inclined orientation when said frame is at said filling station and a horizontal orientation when said frame is at said staging area.

15. The dispenser of claim 14 further comprising an inclined ramp for allowing empty containers to slide toward said filling station, said ramp including a pivotable door for permitting said second elevator to raise a filled container from said staging area past said ramp.

16. The dispenser of claim 15 further comprising a common input-output station, wherein said conveyor system accepts empty containers from and returns filled containers to said common container input-output station.

17. The dispenser of claim 9 wherein said measuring means comprises a load cell.

18. The dispenser of claim 17 wherein said secondary bin includes a pair of downwardly opening doors responsive to said load cell for dispensing a desired portion of food items into an empty container.

19. The dispenser of claim 9 wherein said rotary drum includes a plurality of paddles extending outwardly from said drum for conveying food items from said storage bin.

20. A food dispenser for automatically dispensing portions of bulk food items into baskets comprising:

a storage bin for accepting and holding a quantity of food items;

a secondary bin for receiving a portion of items from said storage bin;

a rotary drum connected between said storage bin and said secondary bin for transferring the food items from said storage bin to said secondary bin;

at least one bin door on said secondary bin for dispensing food items out of said secondary bin;

measuring means for measuring the contents of said secondary bin and for initiating the opening of said bin door when a predetermined amount of food items is measured in said secondary bin; and conveyor means for accepting empty baskets, transporting empty baskets to a basket filling station and returning the filled baskets from said dispenser, said conveyor means including;

an inclined ramp for slidably conveying empty baskets towards said filling station, said ramp having a pivotable inclined ramp portion which can be lowered to permit filled baskets to be raised past said ramp;

a basket stop mechanism for preventing any empty baskets from sliding down said ramp into said filling station;

a first basket elevator having a basket platform for supporting a basket at said filling station and for lowering the filled basket to a filled basket staging area after the basket has been filled;

a second basket elevator for lifting a filled basket from said staging area; and a basket transfer arm for pushing the filled basket horizontally from said first elevator and into said staging area and for advancing any filled baskets already present in said staging area toward said second elevator.

21. The dispenser of claim 20 further comprising a common container input-output station wherein said conveyor means accepts empty baskets from and returns filled baskets to said common container input-output station.

22. The dispenser of claim 20 wherein said measuring means is a load cell.

23. The dispenser of claim 22 wherein said secondary bin includes a pair of downwardly opening doors responsive to a signal from said load cell to dispense a desired portion of food items into a basket.

24. The dispenser of claim 20 wherein said rotary drum includes a plurality of paddles extending outwardly from said drum for conveying food items from said storage bin.

25. A method of dispensing portions of bulk food products comprising the steps of:

loading bulk food products into a storage bin;

discharging food items from the storage bin into a secondary bin;

weighing the secondary bin to determine when a desired portion of food products has accumulated in the secondary bin;

automatically slidably conveying a basket to and from a food receiving position at a basket filling station along a path located within a single vertical plane within the dispenser; and emptying the food products from the secondary bin into the conveyed basket at the basket filling station when the desired portion of food products have accumulated in the secondary bin;

wherein said empty basket conveying step includes the steps of:

sliding an empty basket down an inclined ramp to the basket filling station;

and wherein said containing basket conveying step includes the steps of lowering a food containing basket to a filled basket staging area from said filling station;

horizontally moving the food containing basket into the staging area; and raising a different food containing basket from the staging area.

26. A dispenser for dispensing bulk items into a container comprising:

a storage bin for accepting and holding a quantity of bulk items and having a discharge opening along a bottom portion thereof;

a container filling station;

a storage bin conveying device for conveying items from said storage bin discharge opening to a container at said container filling station; and conveyance means for transporting at least one container to and from said filling station, said container being slidably conveyed on the conveyance system, said conveyance means including inclined ramp means for allowing an empty container to slide by gravity toward said filling station, said conveyance means conveying said container along a path located within the dispenser, said path being within a single substantially vertical plane.

27. The dispenser of claim 26 wherein said conveyance means includes a container stop mechanism for preventing an empty container from sliding down said ramp when a container is removed from said filling station.

28. The dispenser of claim 26 wherein said ramp includes a pivotable door for allowing said conveyance system to raise a filled container past said door when said door is moved from an original inclined ramp position.

29. The dispenser of claim 26 wherein said storage bin conveying device comprises a rotary drum for conveying food items from said storage bin.

30. The dispenser of claim 29 wherein said rotary drum includes at least one paddle for conveying food items from said storage bin.

31. A dispenser for dispensing bulk food items into a container comprising:

a storage bin for receiving and holding a quantity of bulk food items;

secondary bin receiving means for receiving at least a portion of desired size from the contents of said storage bin;

conveyor means for conveying food items from said storage bin to said secondary bin means;

container conveyance means for conveying a container to and from a container filling station, said conveyance means including means for sequentially accepting and positioning a plurality of empty containers and sequentially discharging filled containers, said accepting and positioning means including a downwardly inclined ramp for allowing empty containers to slide towards said container filling station and also including selectively actuatable container stop means for preventing any empty containers on said ramp from sliding downwardly when a filled container is moved from said container filling station; and discharge means for dispensing items from said secondary bin means into an empty container at said filling station.

32. A dispenser for dispensing bulk food items into a container comprising:

a storage bin for receiving and holding a quantity of bulk food items;

secondary bin receiving means for receiving at least a portion of desired size from contents of said storage bin;

conveyor means for conveying food items from said storage bin to said secondary bin receiving means;

container conveyance means for conveying a container to and from a container filling station, said conveyance means including means for sequentially accepting and positioning a plurality of empty containers and sequentially discharging filled containers, said accepting and positioning means including a downwardly inclined ramp for allowing empty containers to slide towards said container filling station, said ramp including a pivotable door for allowing at least a portion of said ramp to be moved to allow filled containers to pass through said ramp from below; and discharge means for dispensing items from said secondary bin means into an empty container at said filling station.

33. A dispenser for dispensing bulk food items into a container comprising:

a storage bin for receiving and holding a quantity of bulk food items;

secondary bin receiving means for receiving at least a portion of desired size from the contents from said storage bin;

conveyor means for conveying food items from said storage bin to said secondary bin means;

container conveyance means for conveying a container to and from a container filling station;

discharge means for dispensing items from said secondary bin means into an empty container at said filling station; and air thaw means for directing air into said dispenser and toward filled baskets to thaw frozen food items contained in the filled baskets.

34. A dispenser for dispensing bulk items into a container comprising:

a storage bin for receiving and holding a quantity of bulk items and having a discharge opening along a bottom portion thereof;

a secondary bin located below said storage bin for receiving a portion of desired size from the items in said storage bin;

storage bin conveying means for conveying items from said storage bin to said secondary bin;

secondary bin emptying means for dispensing the contents of said secondary bin by gravity into an empty container at a bin emptying station;

measuring means for measuring the weight of items in said secondary bin prior to dispensing from said secondary bin; and conveyance means for transporting at least one container to and from said storage bin emptying station, said conveyance means including an inclined ramp for allowing an empty container to slide by gravity to said emptying station.

35. The dispenser of claim 34 wherein said conveyance means includes a selectively actuatable container stop mechanism for preventing an empty container from sliding down said ramp by gravity when a container is removed from said emptying station.

36. A dispenser for dispensing bulk items into a container comprising:

a storage bin for receiving and holding a quantity of bulk items and having a discharge opening along a bottom portion thereof;

a second bin located below said storage bin for receiving a portion of desired size from the items in said storage bin;

storage bin conveying means for conveying items from said storage bin to said secondary bin;

secondary bin emptying means for dispensing the contents of said secondary bin by gravity into an empty container at a bin emptying station;

measuring means for measuring the weight of items in said secondary bin prior to dispensing from said secondary bin; and conveyance means for transporting at least one container to and from said storage bin emptying station, said conveyance means including an inclined ramp having a pivotable door for allowing said conveyance system to raise a filled container past said door when said door is moved from an original inclined ramp position.

37. A food dispenser for dispensing a portion of bulk food items into a container comprising:

a storage bin for accepting and holding a quantity of food items and having a discharge opening along a bottom portion thereof;

a secondary bin for receiving a portion of desired size of food items from said storage bin;

a rotary drum connected between said storage bin and said secondary bin for transferring food items from said storage bin to said secondary bin;

at least one secondary bin door on said secondary bin for dispensing food items from said secondary bin to a filling station;

measuring means for measuring the contents of said secondary bin and initiating the opening of said at least one secondary bin door in response to a predetermined amount of food items measured in said secondary bin; and conveyor means for accepting empty containers, transporting said empty containers to said filling station for filling from said secondary bin and removing the filled containers from said filling station, said conveyor means including an inclined ramp for allowing empty containers to slide by gravity towards said filling station and a selectively actuatable container stop mechanism for preventing an empty basket from sliding down said ramp by gravity.

38. A food container for dispensing a portion of bulk food items into a container comprising:

a storage bin for accepting and holding a quantity of food items and having a discharge opening along a bottom portion thereof;

a secondary bin for receiving a portion of desired size of food items from said storage bin;

a rotary drum connected between said storage bin and said secondary bin for transferring food items from said storage bin to said secondary bin;

at least one secondary bin door on said secondary bin for dispensing food items from said secondary bin to a filling station;

measuring means for measuring the contents of said secondary bin and initiating the opening of at least one secondary bin door in response to a predetermined amount of food items measured in said secondary bin; and conveyor means for accepting empty containers, transporting said empty containers to said filling station for filling from said secondary bin, and removing the filled containers from said filling station, said conveyor means including:

a first container elevator having a container frame for supporting a container at said filling station and for lowering the filled container to a filled container staging area after the container has been filled, said container elevator further including a pivot mechanism for pivoting said basket frame between an inclined orientation when said frame is at said filling station and a horizontal orientation when said frame is at said staging area;

a second container elevator for lifting a filled container from said staging area; and a container transfer arm for pushing the filled container horizontally from said first elevator and for advancing any filled containers already present in said staging area towards said second elevator, thereby pushing a filled container nearest said second elevator onto said second elevator; and an inclined ramp for allowing empty containers to slide towards said filling station, said ramp including a pivotable door for permitting said second elevator to raise a filled container from said staging area past said ramp.

39. The dispenser of claim 38 wherein said conveyor system accepts empty containers from and returns filled containers to a common container input-output station.

40. A food dispenser for dispensing a portion of bulk food items into a container comprising:

a storage bin for accepting and holding a quantity of food items and having a discharge opening along a bottom portion thereof;

a secondary bin for receiving a portion of desired size of food items from said storage bin;

a rotary drum connected between said secondary bin and said storage bin for transferring food items from said storage bin to said secondary bin;

at least one secondary bin door on said secondary bin for dispensing food items from said secondary bin to a filling station;

measuring means for measuring the contents of said secondary bin and initiating the opening of at least one secondary bin door in response to a predetermined amount of food items measured in said secondary bin; and conveyor means for accepting empty containers, transporting said empty containers to said filling station for filling from said secondary bin, and removing the filled containers from said filling station, said conveyor means including:

a first container elevator having a container frame for supporting a container at said filling station and for lowering the filled container to a filled container staging area after the container has been filled;

a second container elevator for lifting a filled container from said staging area; and a container transfer arm for pushing the filled container horizontally from said first elevator and for advancing any filled containers already present in said staging area towards said second elevator, thereby pushing a filled container nearest said second elevator onto said second elevator;

said dispenser further comprising an air thaw system for directing air towards said dispenser staging area for thawing frozen food items held therein.

* * * * *